US005177409A

United States Patent [19]

Nilssen

[11] Patent Number: 5,177,409

[45] Date of Patent: Jan. 5, 1993

[54] CONTROLLABLE ELECTRONIC BALLAST

[76] Inventor: Ole K. Nilssen, Caesar Dr., Rte. 5, Barrington, Ill. 60010

[21] Appl. No.: 851,261

[22] Filed: Mar. 13, 1992

Related U.S. Application Data

[63] Continuation of Ser. No. 500,116, Mar. 27, 1990, abandoned, which is a continuation of Ser. No. 2,275, Jan. 12, 1987, abandoned.

[51] Int. Cl.[5] ..... H05B 37/00

[52] U.S. Cl. ..... 315/293; 315/307; 315/DIG. 4; 315/DIG. 7; 315/150

[58] Field of Search ..... 315/307, DIG. 7, DIG. 4, 315/DIG. 5, 86, 129, 150, 151, 293, 297, 200 R

[56] References Cited

U.S. PATENT DOCUMENTS

| | | | |
|---|---|---|---|
| 3,284,667 | 11/1966 | Harris et al. | 315/DIG. 4 |
| 3,940,660 | 2/1976 | Edwards | 315/DIG. 4 |
| 4,359,670 | 11/1982 | Hosaka et al. | 315/307 |
| 4,383,204 | 5/1983 | Roberts | 315/DIG. 4 |
| 4,513,364 | 4/1985 | Nilssen | 363/132 |
| 4,575,659 | 3/1986 | Pezzolo et al. | 315/DIG. 4 |
| 4,649,323 | 3/1987 | Pearlman et al. | 315/307 |
| 4,665,346 | 5/1987 | Tarroux | 315/DIG. 7 |
| 4,733,138 | 3/1988 | Pearlman et al. | 315/293 X |
| 4,792,729 | 12/1988 | Peters | 315/DIG. 4 X |
| 4,803,406 | 2/1989 | Yasuda et al. | 315/86 X |
| 4,833,339 | 5/1989 | Luchaco et al. | 315/DIG. 4 X |
| 4,862,041 | 8/1989 | Hirschmann | 315/DIG. 4 X |
| 4,874,989 | 10/1989 | Nilssen | 315/307 X |
| 4,876,498 | 10/1989 | Luchaco et al. | 315/DIG. 4 X |
| 4,887,004 | 12/1989 | Kraaij et al. | 315/86 |
| 4,888,526 | 12/1989 | Nilssen | 315/DIG. 5 X |
| 4,896,078 | 1/1990 | Nilssen | 315/DIG. 5 X |
| 4,954,768 | 9/1990 | Lucharo et al. | 315/DIG. 4 X |
| 4,972,126 | 11/1990 | Nilssen | 315/DIG. 5 X |
| 4,977,351 | 12/1990 | Bavaro et al. | 315/86 X |

*Primary Examiner*—Robert J. Pascal

[57] ABSTRACT

In an electronic ballast for fluorescent lamps, means are provided by which the lamps are powered at their normal level whenever power line voltage is initially connected to the ballast. However, if the power line voltage is disconnected and then re-connected within about two seconds, the lamps will be powered at a lower-than-normal level; which lower-than-normal level will remain in effect until the power line voltage is once again disconnected and not re-connected until more than about two seconds have passed.

14 Claims, 3 Drawing Sheets

CONTROLLABLE ELECTRONIC BALLAST

RELATED APPLICATIONS

The present application is a continuation of application Ser. No. 07/500,116, filed Mar. 27, 1990, now abandoned, which is a continuation of application Ser. No. 07/002,275, filed Jan. 12, 1987, now abandoned.

BACKGROUND OF THE INVENTION

1. Field of Invention

The invention relates to ballasts for gas discharge lamps, particularly of a kind having means to permit the power supplied to the lamps to be adjusted by timed connection/disconnection of the ballast with/from its source of power.

2. Elements of Prior Art

It is well known that significant improvements in overall cost-effectivity of the lighting function can result from appropriately controlling the level of light output from lighting fixtures used for general lighting in offices and the like.

Fluorescent lamp ballasting systems adapted to permit control of light output level on a systems basis presently do exist—as for instance in accordance with U.S. Pat. Nos. 4,207,498 and 4,350,935 to Spira et al.

However, there are significant complexities associated with practical applications of such light level control systems; and, in spite of the very significant improvements potentially available in overall lighting efficacy, such light control systems have not gained wide acceptance.

3. Inventive Rationale

A significant part of the value available from a light control system may be attained by simply permitting the light level to be readily adjustable between a normal brightness level and a reduced brightness level.

However, to make this kind of approach commercially attractive, it must be very simple to install and use; and it must not represent a significant cost-penalty.

For instance, if—perhaps by the use of some special electronic ballasts in the lighting fixtures—it were to be possible just to flick the light switch OFF and ON again in order to establish a reduced light level, no special light dimmers would be needed, and no special wiring would be required.

SUMMARY OF THE INVENTION

Objects of the Invention

An object of the present invention is that of providing means whereby the light output level of a lighting fixture may be automatically and/or manually adjusted and/or controlled.

Another object is that of providing means whereby the light output level of a lighting fixture may be adjusted by way of manipulating the ON/OFF power switch controlling the supply of power to the fixture.

Still another object is that of providing a gas discharge lamp ballast having built-in means for effecting adjustment of the amount of power provided from its output by way of briefly disconnecting the ballast from its source of power.

These as well as other objects, features and advantages of the present invention will become apparent from the following description and claims.

BRIEF DESCRIPTION

In its preferred embodiment, the present invention constitutes a power-line-operated inverter-type ballast that provides to fluorescent lamps in a lighting fixture a high-frequency current having magnitude that is inversely related to the frequency of the ballast output voltage. The ballast comprises a self-oscillating inverter wherein the frequency of oscillation can be influenced by receipt of a control signal at a pair of control terminals connected in circuit with the inverter's positive feedback circuit. The ballast also comprises built-in optical sensor means so positioned and constituted as to sense the light level within the lighting fixture within which the ballast is mounted, and to provide a control signal commensurate with that light level. This control signal is then applied to the control terminals in such manner as to regulate the inverter frequency as a function of the light level, thereby correspondingly to regulate the magnitude of the current fed to the fluorescent lamps. By way of an adjustable threshold means, a threshold level is provided; which, in combination with a high gain control loop, accurately maintains fixture light level at any desired value regardless of any changes in magnitude of power line voltage and/or in lamp efficacies.

The adjustable threshold means is so constituted and arranged as to automatically assume a first threshold level upon initial application of power line voltage to the ballast. This first threshold level, which corresponds to normal light output, will then prevail until the power line voltage is disconnected.

However, if the power line voltage is disconnected for just a brief period—for not more than about two seconds—the threshold means will automatically assume a second threshold level. This second theshold level, which corresponds to a reduced level of light output, will then prevail until the power line voltage is disconnected for a period longer than two seconds.

The inverter's positive feedback is attained by way of saturable current transformer means, and control of inverter frequency is attained by providing more or less heat to the saturable magnetic material of the current transformer means, thereby correspondingly to decrease or increase the saturation limits of this magnetic material; which, in turn, correspondingly increases or decreases the frequency of inverter oscillation.

DESCRIPTION OF THE PREFERRED EMBODIMENT

Description of the Drawings

Figure 1:
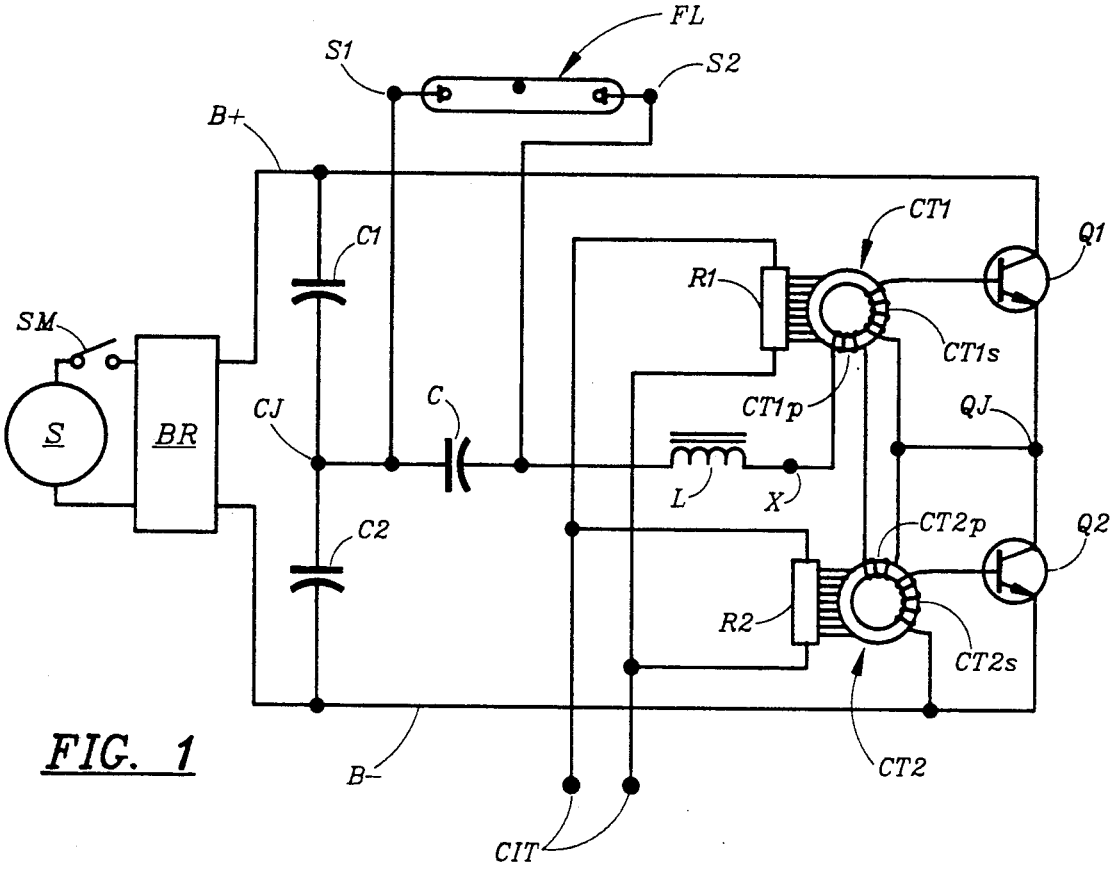
FIG. 1 diagrammatically illustrates a power-line-operated self-oscillating inverter-type ballast circuit with saturable transformer means in its positive feedback path and with electrical input means for affecting control of the inversion frequency.

In FIG. 1, a source S of 120 Volt/60 Hz voltage is applied to a full-wave bridge rectifier BR by way of a switch means SM. The unidirectional voltage output from the bridge rectifier is applied directly between a B+ bus and a B− bus, with the positive voltage being connected to the B+ bus.

Between the B+ bus and the B− bus are connected a series-combination of two transistors Q1 and Q2 as well as a series-combination of two energy-storing capacitors C1 and C2.

The secondary winding CT1s of positive feedback current transformer CT1 is connected directly between the base and the emitter of transistor Q1; and the secondary winding CT2s of positive feedback current transformer CT2 is connected directly between the base and the emitter of transistor Q2.

The collector of transistor Q1 is connected directly with the B+ bus; the emitter of transistor Q2 is connected directly with the B− bus; and the emitter of transistor Q1 is connected directly with the collector of transistor Q2, thereby forming junction QJ.

One terminal of capacitor C1 is connected directly with the B+ bus, while the other terminal of capacitor C1 is connected with a junction CJ. One terminal of capacitor C2 is connected directly with the B− bus, while the other terminal of capacitor C2 is connected directly with junction CJ.

An inductor L and a capacitor C are connected in series with one another and with the primary windings CT1p and CT2p of transformers CT1 and CT2.

The series-connected primary windings CT1p and CT2p are connected directly between junction QJ and a point X. Inductor L is connected with one of its terminals to point X and with the other of its terminals to one of the terminals of capacitor C. The other terminal of capacitor C is connected directly with junction CJ.

A fluorescent lamp FL is connected, by way of lamp sockets S1 and S2, in parallel circuit with capacitor C.

Respectively, the two current transformers CT1 and CT2 are thermally connected with heating resistors R1 and R2; which two resistors are parallel-connected across control input terminals CIT.

Figure 2:
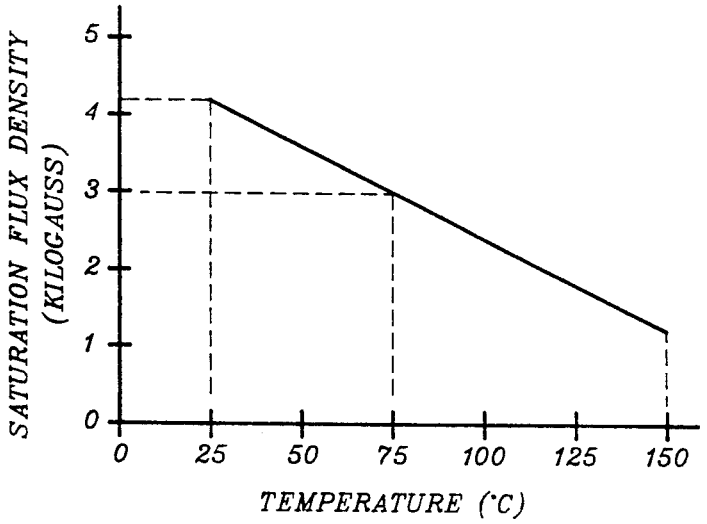
FIG. 2 illustrates the effect of temperature on the saturation characteristics of the magnetic material used in the saturable transformer means.

FIG. 2 shows the relationship between temperature and saturation flux density of the Ferroxcube 3E2A ferrite material used in feedback current transformers CT1 and CT2.

Figure 3:
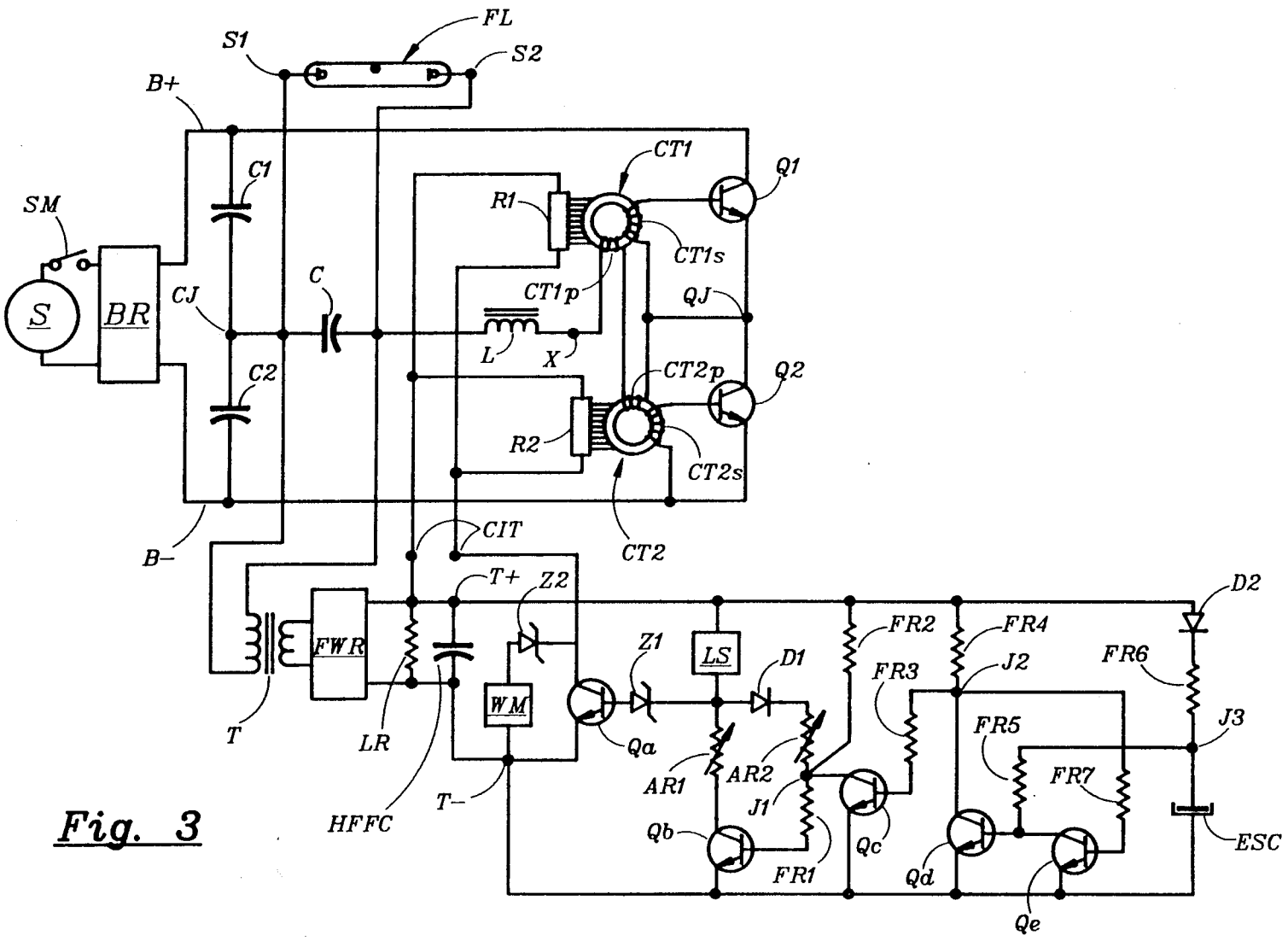
FIG. 3 provides a schematic circuit diagram of the preferred electrical circuit embodiment of the present invention, showing the inverter-type ballast circuit of FIG. 1 combined with optical sensor means and control feedback means operable to maintain the light output from the fluorescent lamp constant an either of two selectable levels.

FIG. 3 shows the inverter-type ballast circuit of FIG. 1 arranged such as to provide for automatic control of light output from the fluorescent lamp.

A transformer T is connected with its primary winding across capacitor C; its secondary winding is connected with the AC input terminals of a full-wave rectifier FWR. The positive and negative terminals of the DC output of this rectifier are respectively marked T+ and T−.

A high-frequency filter capacitor HFFC and a load resistor LR are connected in parallel between T+ and T−.

A transistor Qa is connected with its collector to the T+ terminal by way of the CIT terminals; and it is connected with its emitter to the T− terminal.

A light sensor LS is connected between the T+ terminal and the cathode of a first Zener diode Z1. The anode of Zener diode Z1 is connected with the base of transistor Qa. A first adjustable resistor AR1 is connected between the cathode of the Zener diode and the collector of a transistor Qb, the emitter of which is connected with the T− terminal.

A first diode D1 is connected with its anode to the cathode of Zener diode Z1. A second adjustable resistor AR2 is connected between the cathode of diode D1 and a junction J1; and a first fixed resistor FR1 is connected between junction J1 and the base of transistor Qb. A second fixed resistor FR2 is connected between the T+ terminal and junction J1. A transistor Qc is connected with its collector to junction J1 and with its emitter to the B− terminal. Its base is connected with a junction J2 by way of a third fixed resistor FR3.

A fourth fixed resistor FR4 is connected between the T+ terminal and junction J2. A transistor Qd is connected with its collector to junction J2 and with its emitter to the B− terminal. A fifth fixed resistor FR5 is connected between the base of transistor Qd and a junction J3. An energy-storing capacitor ESC is connected between junction J3 and the T− terminal; and a sixth fixed resistor FR6 is connected between junction J3 and the cathode of a diode D2. The anode of diode D2 is connected with the T+ terminal.

A transistor Qe is connected with its collector to the base of transistor Qd and with its emitter to the T− terminal. A seventh fixed resistor FR7 is connected between the base of transistor Qe and junction J2.

A second Zener diode Z2 is connected with its cathode to the collector of transistor Qa; and a warning means WM is connected between the anode of Z2 and the T− terminal.

Figure 4:
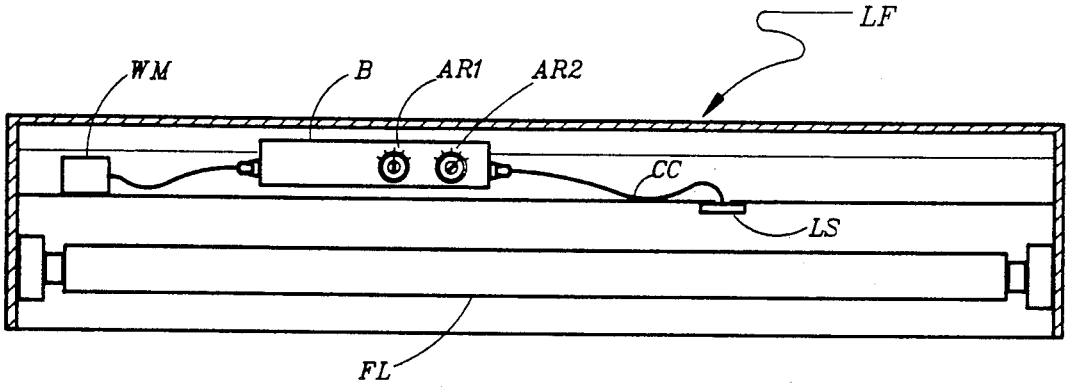
FIG. 4 shows one way of applying the ballast circuit of FIG. 3 to a fluorescent lighting fixture.

FIG. 4 schematically illustrates the use of a ballast B, as made in accordance with the preferred embodiment of FIG. 3, in a lighting fixture LF, which is shown in quasi-cross-section.

The light sensor LS, which is shown as being placed just above the fluorescent lamp FL, is plug-in connected with the ballast B by way of a light-weight connect cord CC. Adjustable resistors AR1 and AR2 are indicated as being accessible for adjustment from the side of the ballast; and warning means WM is indicated as being mounted on the side of the lighting fixture and plugged into the ballast in manner similar to that of the light sensor.

Figure 5:
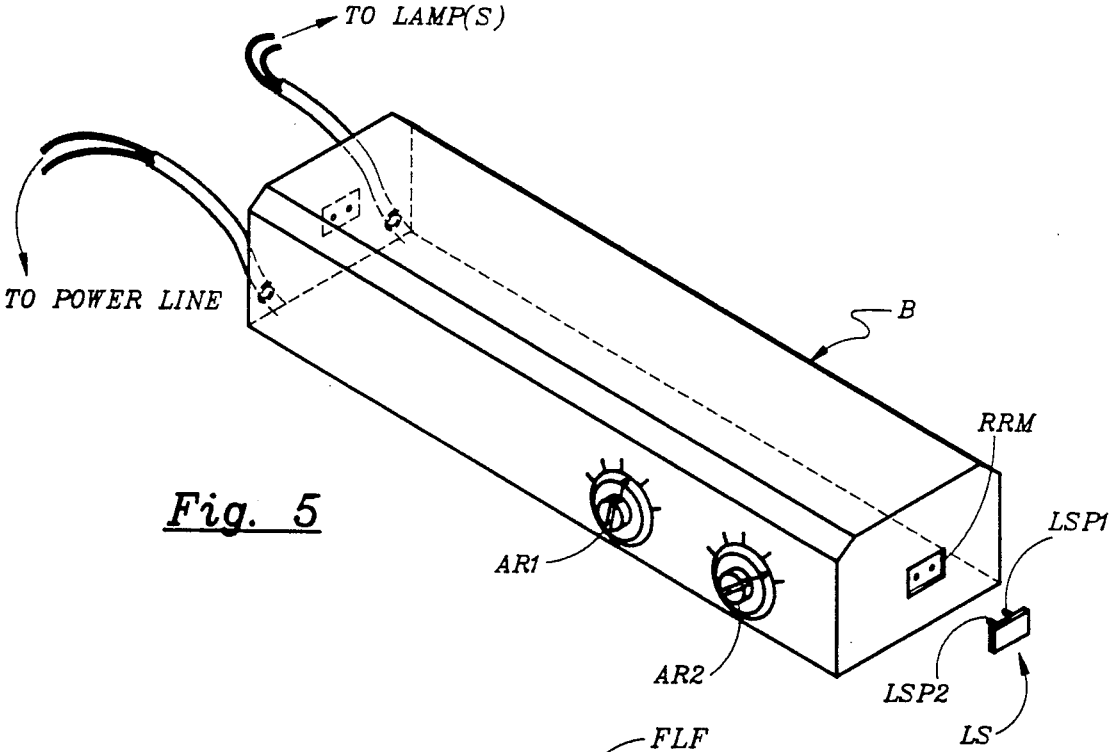
FIG. 5 illustrates the preferred physical embodiment of the ballast circuit of FIG. 3, showing particularly the optical sensor means as an integral part of the ballast structure.

FIG. 5 shows the preferred physical implementation of a complete electronic ballast in accordance with the preferred electrical implementation illustrated in FIG. 3.

In FIG. 5, ballast B comprises recessed receptacle means RRM operative to receive and hold light sensor LS by way of two electrical connect and mechanical support prongs LSP1 and LSP2.

Figure 6:
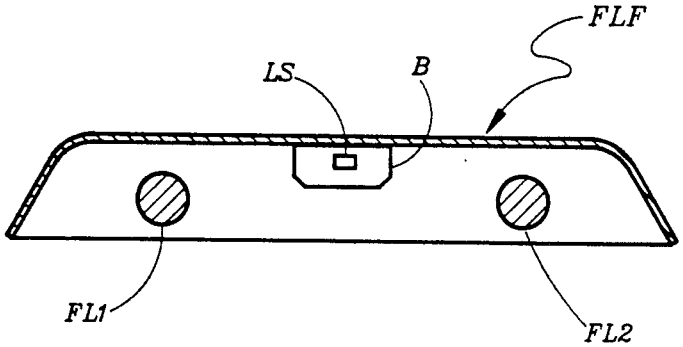
FIG. 6 shows the ballast of FIG. 5 as used in a fluorescent lighting fixture.

FIG. 6 illustrates the use of ballast B in a fluorescent lighting fixture FLF; which is shown in a cross-sectional view, indicating two fluorescent lamps FL1 and FL2. The ballast is positioned in such manner that some of the light from the lamps is intercepted by the ballast's light sensor LS.

Description of Operation

In FIG. 1, source S represents an ordinary electric utility power line, the voltage from which is applied directly to the bridge rectifier identified as BR. This bridge rectifier is of conventional construction and provides for the rectified line voltage to be applied to the inverter circuit by way of the B+ bus and the B− bus.

The two energy-storing capacitors C1 and C2 are connected directly across the output of the bridge rectifier BR and serve to filter the rectified line voltage, thereby providing for the voltage between the B+ bus and the B− bus to be substantially constant. Junction CJ between the two capacitors serves to provide a power supply center tap.

The inverter circuit of FIG. 1, which represents a so-called half-bridge inverter, operates in a manner that is analogous with circuits previously described in published literature, as for instance in U.S. Pat. No. Re. 31,758 to Nilssen entitled High Efficiency Push-Pull Inverters.

The inverter circuit is shown without any means for initiating inverter oscillation. However, once B+ power is applied, oscillation can be initiated simply by momentarily connecting a 50 nF capacitor between the B+ bus and the base of transistor Q2. Or, as is used in many other inverter circuits, an automatic triggering arrangement consisting of a resistor, capacitor, and a Diac may be used.

At a temperature of 25 Degrees Centigrade, the output of the half-bridge inverter is a substantially squarewave 33 kHz AC voltage. This squarewave voltage is provided between point X and junction CJ. Across this squarewave voltage output is connected a resonant or near-resonant L-C series circuit—with the fluorescent lamp being connected in parallel with the tank-capacitor (C) thereof.

The resonant or near-resonant action of the L-C series circuit provides for appropriate lamp starting and operating voltages, as well as for proper lamp current limiting; which is to say that it provides for appropriate lamp ballasting.

(Resonant or near-resonant ballasting has been described in previous publications, as for instance in U.S. Pat. No. 3,710,177 entitled Fluorescent Lamp Circuit Driven Initially at Lower Voltage and Higher Frequency.)

The inverter frequency may be controlled by controlling the temperature of the magnetic cores of the feedback current transformers, as can best be understood by recognizing that—in the inverter circuit of FIG. 1—the ON-time of a given transistor is a direct function of the saturation flux density of the magnetic core in the saturable feedback transformer associated with that transistor. Thus, other things being equal and in view of the relationship illustrated by FIG. 2, the inversion frequency is a substantially proportional function of the temperature of the ferrite cores used in CT1 and CT2.

However, it should also be understood that the transistor ON-time is a substantially inverse proportional function of the magnitude of the voltage presented to the secondary windings of the saturable feedback current transformers by the base-emitter junctions of the two transistors. That is, other things being equal, the inversion frequency is substantially a proportional function of the magnitude of this junction voltage; which is to say, since the magnitude of this junction voltage decreases in approximate proportion to temperature, that the inversion frequency decreases with increasing temperature on the transistors.

When combining the two effects outlined above, and by matching the effects on the inversion frequency due to the temperature effects of ferrite material with those of the counter-working temperature effects of the transistors' base-emitter junction, it is possible substantially to cancel any change in inversion frequency that otherwise might result from temperature changes occuring in a normally operating inverter circuit.

However, aside from any normally occuring changes in the inversion frequency, it is possible in a cost-effective and practical manner to cause substantial additional changes in the inversion frequency. Such changes can controllably be accomplished by way of providing an adjustable flow of additional heat to the ferrite cores of the saturable feedback transformers.

Such flow of additional heat is accomplished by way of the two resistors identified as R1 and R2; which two resistors are coupled to the ferrite cores in close thermal relationship.

A given flow of power to the two resistors causes a corresponding proportional temperature rise of the ferrite material. Thus, the inversion frequency will increase from its base value in approximate proportion to the power input to the resistors.

In the circuit of FIG. 1, the purpose of controlling frequency is that of effecting control of the power output, which is accomplished by way of placing a frequency-dependent or reactive element in circuit with the load. That way, as the frequency is varied, the flow of power to the load is varied in some corresponding manner.

For extra effective control, this reactive element can be a tuned circuit—as indeed is used in the arrangement of FIG. 1 —in which case the degree of power flow control for a given degree of frequency control is enhanced by the frequency-selective characteristics of the tuned circuit.

In the particular case of FIG. 1, with no power being provided to resistors R1 and R2, the power supplied to the fluorescent lamp load is approximately 30 Watt. With a power flow of about 1 Watt provided to resistors R1 and R2, the power supplied to the fluorescent lamp load is only about 4 Watt.

Thus, by controlling the amount of power being provided to control input terminals CIT, the light output of fluorescent lamp FL may be controlled over a wide range.

However, it should be realized that by controlling the light output of fluorescent lamp FL by way of controlling the temperature of the ferrite material in the feedback current transformers, as herein described, the response time can not be instantaneous. While such delayed response may be annoying in conventional light dimming applications, it is of little significance in several other important applications.

In particular, with reference to FIG. 3, the relatively long response time does not constitute a significant detriment in connection with controlling the light output against such effects as: i) changes in the magnitude of the voltage applied to the inverter from source S, ii) variations in the efficacy of the fluorescent lamp, whether these variations be due to lamp manufacturing differences or lamp aging, iii) variations in the ambient temperature to which the fluorescent lamp is subjected, and iv) variations in the ambient temperature to which the ballast itself is subjected.

More particularly, the ballast circuit of FIG. 3 illustrates how the circuit of FIG. 1 is used to provide for automatic control of the light output of the fluorescent lamp. In FIG. 3, the light output level is sensed by light sensor LS, which is of such nature that its effective resistance decreases as the light flux received by it increases. Thus, the magnitude of the voltage developing at the cathode of Zener diode Z1 increases with decreasing light output.

Depending upon the net effective resistance present between the cathode of Zener diode Z1 and the T− terminal, with increasing light output, there comes a point at which the magnitude of the voltage at the cathode of Zener diode Z1 gets to be so high as to cause current to flow through Zener diode Z1 and into the base of transistor Qa; which then causes power to be provided to resistors R1 and R2. In turn, the power provided to these resistors will cause heating of the ferrite cores of feedback transformers CT1 and CT2, thereby reducing the amount of power supplied by the ballast to the fluorescent lamp.

As an overall result, for a given effective resistance present between the cathode of Zener diode Z1 and the T− terminal, the light output from the lamp will be kept substantially constant at a level determined principally by the threshold provided in the control feedback loop; which threshold is determined by the sum of the voltage drop across the Z1 Zener diode and that of the base-emitter junction of transistor Qa.

Thus, with adequate gain in the total feedback loop, the light output will be maintained at a substantially constant level characterized by the point at which the magnitude of the voltage at the cathode of Zener diode Z1 this threshold—that is, reaches a threshold high enough to cause current to flow through the Z1 Zener diode and into the base of transistor Qa.

If the light output level were to fall below this threshold, current would cease flowing through transistor Qa, and power flow to the ferrite cores will be choked off; thereby causing the cores to cool down and, as a result, more power to be provided to the lamp.

Whenever the light output is inadequate to cause the magnitude of the voltage at the cathode of Zener diode Z1 to reach the threshold, base current ceases to be provided to Qa, and the magnitude of the voltage across Qa will reach its maximum level; which maximum level is principally determined by the magnitude of the voltage between the T− and the T+ terminals.

In turn, this magnitude is determined by the voltage developing across the fluorescent lamp in combination with the voltage transformation ratio of transformer T.

The parameters of Zener diode Z2 and warning means WM are so chosen that power will be provided to warning means WM (which is a simple LCD means parallel-loaded with a leakage resistor) whenever the magnitude of the voltage across Qa reaches its maximum level; which means that a warning will be provided whenever the light output from fluorescent lamp FL fails to reach a certain level.

The net effective resistance present between the cathode of Zener diode D1 and the T− terminal depends on conditions as follows.

When transistor Qc is in its conductive state, which represents a situation defined as normal, the net effective resistance between the cathode of Zener diode Z1 and the T− terminal is principally determined by the setting of adjustable resistor AR2.

When transistor Qb is in its conductive state, which represents a situation defined as special, the net effective resistance between the cathode of Zener diode Z1 and the T− terminal is principally determined by the setting of adjustable resistor AR1.

Transistors Qb and Qc, in combination with their associated circuitry, are arranged to operate in a bistable manner and such that one of them must always exist in its fully conductive state, while the other one must then exist in its fully non-conductive state. Which particular transistor will exist in its fully conductive state, depends on certain conditions, as follows.

When voltage is initially established between the T+ terminal and the T− terminal, capacitor ESC is discharged; which means that no current will initially be provided from junction J3 to the base of transistor Qd, therefore making transistor Qd initially non-conductive.

Thus, when voltage is initially established between T+ and T−, current will be provided to the base of transistor Qc by way of resistors FR3 and FR4 (without interference from transistor Qd), thereby causing transistor Qc to enter its fully conductive state. With transistor Qc in its fully conductive state, junction J1 is effectively brought to the same potential as the T− terminal, thereby keeping transistor Qb in its fully non-conductive state.

After a few seconds, the voltage on capacitor ESC reaches a magnitude about equal to that of the voltage existing between T− and T+; which means that current flows through resistor FR6 toward the base of transistor Qd. However, by this time, transistor Qe exists in its fully conductive state, thereby shunting current away from the base of transistor Qd and ensuring that transistor Qd remains in its fully non-conductive state.

In other words, when normally connecting the ballast arrangement of FIG. 3 with the power line, transistor Qc will automatically be placed in its fully conductive state; and the light output level will be governed by the setting of adjustable resistor AR2.

On the other hand, if connection with the power line is briefly interrupted, the following events occur.

The magnitude of the voltage existing between T− and T+ (i.e., across filter capacitor HFFC) will rapidly decay; while the magnitude of the voltage on capacitor ESC will decay much more slowly.

If the power line is re-connected after a period of between one and two seconds, the magnitude of the voltage on capacitor HFFC will have decayed to a nearly negligible level, but that of the voltage on capacitor ESC will still be large enough to provide enough base current to transistor Qd to cause this transistor to exist in its fully conductive state. Thus, at the moment the power line is re-connected, transistor Qd is fully conductive, thereby ensuring that junction J2 will be at the potential of the T− terminal.

As a result, both transistors Qc and Qe are now prevented from entering their fully conductive states; which implies that the magnitude of the voltage at junction J1 will rise to a level near that of the voltage on the T+ terminal; which further implies that transistor Qb will enter its fully conductive state, thereby effectively connecting adjustable resistor AR1 between the base of Zener diode Z1 and the T− terminal.

In other words, when re-connecting the ballast arrangement of FIG. 3 with the power line after a brief period of disconnection, transistor Qb will automatically be placed in its fully conductive state; and the light output level will now be governed by the setting of adjustable resistor AR1.

FIG. 4 shows a fluorescent lighting fixture wherein a ballast B, made in accordance with the ballast circuit of FIG. 3, is positioned and connected with the fixture's fluorescent lamp(s) in a substantially ordinary manner.

Calibrated means for adjusting the magnitudes of resistors AR1 and AR2 are accessible from the outside of the ballast.

Light sensor LS and warning means WM are each provided as an entity at one end of a light-weight electrical cord; which cord has a plug at its other end. This plug is adapted to be plugged into a receptacle in the ballast itself, thereby to be properly connected in circuit with the feedback loop.

The complete feedback loop is electrically isolated from the power line and the main ballast circuit; which therefore readily permits both LS and WM, as well as their receptacles, cords and plugs, to be made and installed in accordance with the specifications for Class-2 or Class-3 electrical circuits, as defined by the National Electrical Code.

Light sensor LS is positioned in such a way as to be exposed to the ambient light within the fixture; warning means WM is placed in a location whereby it is readily visible from some suitable place external of the fixture; and ballast B is placed in such manner as to provide for adjustable resistors RA1 and RA2 to be reasonably accessible for adjustment.

The main purpose of warning means WM, which represents a totally optional feature, is that of providing a visually discernable signal to the effect that it is time to change the lamp(s) in the fixture.

The main purpose of adjustable resistors AR1 and AR2 is that of permitting independent adjustment of the levels of light to be provided from the fixture under the two conditions: i) the normal condition when simply turning the light ON without any special precautions, and ii) the special condition of turning the light OFF for about a second or so, before turning it back ON again.

Of course, as with LS and WM, AR1 and AR2 could just as well have been provided as plug-in entities at the end of light-weight cords.

FIG. 5 illustrates ballast B in further physical detail, particularly showing how the light sensor can be included as a mechanically integral part of the ballast: being plugged into and physically held by recessed receptacle means RRM. Thus, there is no need to provide the light sensor on a cord (as indicated in FIG. 4), although in some applications it is definitely advantageous to do so. Instead, as indicated in FIG. 5, the light sensor can be rigidly combined with the rest of the ballast structure.

In most ordinary applications, with the light sensor as a mechanically integral part of the ballast, it is only necessary to mount the ballast in the fixture in such manner that part of the light from the fluorescent lamps will be intercepted by the light sensor—as illustrated by FIG. 6.

However, even if the ballast were to be mounted in separate compartment, it would only be necessary to provide an aperture between the ballast compartment and the compartment comprising the fluorescent lamps, and then to arrange for some of the lamp light to be intercepted by this aperture. Of course, it would also be necessary to mount the ballast in such a relationship with the aperture that the ballast's light sensor would intercept part of the light coming through the aperture.

As indicated in FIG. 6, providing the light sensor as a mechanically integral part of the ballast makes it particularly convenient to mount the ballast in the fixture—requiring no wiring other than that required with any ordinary ballast.

Additional Comments a) When a fluorescent lamp is initially provided with power, its light output will be substantially lower than it will be once the lamp has warmed up to proper operating temperature. Under most normal circumstances, the ballast of FIG. 3 provides compensation for this effect, in that the lamp will automatically be provided with substantially more power as long as the light output is not up to the desired level.

During its initial warm-up period, the warning means may indicate a need to replace the lamp. However, the warning signal should be disregarded, or at least interpreted with special care, during this initial lamp warm-up period.

b) In order for the feedback control loop to be considered as a Class-2 electrical circuit, it is convenient to limit the magnitude of the DC voltage provided between terminals T− and T+ to about 30 Volt. Also, the magnitude of the maximum current available therefrom should be limited to 8 Amp.

c) To provide for even more accuracy in the control feedback function, the magnitude of the voltage provided between the T− and the T+ terminals could be regulated with a separate Zener diode. However, for most applications, the degree of voltage regulation provided by the fluorescent lamp should be adequate.

d) Instead of providing just the light sensor as a separate plug-in entity, it would be just as feasible to provide almost the whole control circuit (up to the secondary winding of transformer T) as a plug-in entity.

Thus, the basic ballast would not be significantly cost-penalized for those who would wish to use the ballast without the feature of adjustable automatic light output control.

e) A significant value associated with providing the ballast in the form illustrated by FIG. 5 is that it permits the ballast to be provided, mounted and used in a manner completely analogous to that of an ordinary ballast; yet, by simply providing a different version of the light sensor, the arrangement indicated in FIG. 4 can readily be accomodated.

f) The main values associated with providing automatic light output control as herein described relates to energy-efficiency:

i) For a specified level of light output, by compensating for line voltage fluctuations and lamp light output deterioration over time, an overall efficiency-advantage of nearly 20% is attained; which 20% efficiency-advantage comes on top of the over 20% efficiency-advantage associated with using an electronic ballast in the first place.

ii) By readily permitting the attainment of a second (reduced) light output level—namely, by briefly disconnecting the supply of power—it is possible to provide for additional energy savings by providing a more accurately appropriate level of light at certain times, such as after normal office hours.

g) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a power line operative to provide an AC power line voltage at a pair of power line terminals;

a switch means connected between the power line terminals and a pair of power input terminals; the switch means being operative, in response to controllable switching actions, to cause the power input terminals at certain times to be connected with, and at other times to be disconnected from, the power line terminals; the power input terminals being connected with the power line terminals prior to a first point in time; starting at this first point in time, the power input terminals are disconnected for a brief period of time from the power line terminals; after this brief period of time, the power input terminals are again connected with the power line terminals;

a lamp having a pair of lamp terminals; and a power conditioner circuit connected with the power input terminals and having a pair of power output terminals connected with the lamp terminals; the power conditioner being characterized by: (i) prior to the first point in time, providing a first level of power to the lamp; (ii) after the brief period of time, providing a second level of power to the lamp; and (iii) the second level of power being lower than the first level of power provided the brief period of time is no longer than a certain pre-determined duration.

2. The arrangement of claim 1 wherein the lamp is a gas discharge lamp.

3. The arrangement of claim 1 wherein any power provided to the lamp is provided by way of an alternating lamp current of frequency substantially higher than that of the AC power line voltage.

4. The arrangement of claim 1 wherein the magnitude of any current provided to the lamp is substantially independent of any normal variations in the magnitude of the AC power line voltage.

5. The arrangement of claim 1 wherein the power conditioner circuit is further characterized by including an adjustment means operative to permit adjustment of the second level or power.

6. The arrangement of claim 1 wherein the power conditioner circuit is further characterized by including: (i) rectifier means connected with the power input terminals and operative to provide a DC voltage at a pair of DC terminals; and (ii) inverter means connected with the DC terminals and operative to provide power to the power output terminals.

7. The arrangement of claim 2 wherein: (a) is additionally included a lighting fixture means operative to house the gas discharge lamp and the power conditioner circuit; and (b) the power conditioner circuit is further characterized by including (i) a control input which, in response to a control signal, is operative to control the first level of power, and (ii) a light sensor connected with the control input and disposed such as to be exposed to the luminuous output of the gas discharge lamp, thereby to provide the control signal to the control input such as to cause the first level of power to be controlled in such manner as to maintain a given level of light output regardless of ordinary variations in the magnitude of the AC power line voltage or in the luminous efficacy of the gas discharge lamp.

8. The arrangement of claim 1 wherein the switch means is an ordinary ON/OFF switch.

9. In a lighting system powered via a pair of power distribution conductors from the power line voltage on an ordinary electric utility power line, the lighting system including control means operative to cause the power line voltage supplied to the power distribution conductors to be switched ON and OFF from time to time, the improvement comprising:

a lighting fixture having a pair of power input terminals connected with the power distribution conductors and including:

(a) a lamp having a pair of lamp terminals; and (b) a power conditioner circuit connected with the power input terminals and having a pair of power output terminals connected with the lamp terminals; the power conditioner being characterized by: (i) prior to a given point in time, providing a first level of power to the lamp; (ii) after that given point in time, in the event the supply of power line voltage were to be removed for but a brief period of time, providing a second level of power to the lamp after such event; and (iii) the second level of power being lower than the first level of power as long as the brief period of time be shorter than a pre-determined duration.

10. The improvement of claim 9 wherein the predetermined duration is between zero and ten seconds.

11. The improvement of claim 9 wherein, in the event the brief period of time were to be longer than the predetermined duration, the power conditioner would provide the first level of power to the lamp.

12. In a lighting fixture having a pair of power input terminals connected with a pair of power distribution conductors being controllably supplied with the power line voltage from an ordinary electric utility power line; from time to time, the power line voltage being removed from the power input terminals for a brief period of time; the improvement comprising:

a gas discharge lamp having a pair of lamp terminals; and a power conditioner circuit connected with the power input terminals and having a pair of power output terminals connected with the lamp terminals; the power conditioner being characterized by: (i) prior to a given point in time, providing a first level of power to the lamp; (ii) after that given point in time, in an event during which the supply of power line voltage were to be removed for a brief period of time, providing a second level of power to the lamp after such event; (iii) the second level of power being lower than the first level of power in case the brief period of time be shorter than a predetermined duration; and (iv) the second level of power being the same as the first level of power in case the brief period of time be longer than the pre-determined duration.

13. The improvement of claim 12 wherein the predetermined duration if between zero and ten seconds.

14. The improvement of claim 12 wherein any power provided to the lamp is provided in the form of a high-frequency current; the frequency of the high-frequency current being substantially higher than the frequency of the power line voltage.

* * * * *